US008272903B2

(12) United States Patent
Lin

(10) Patent No.: US 8,272,903 B2
(45) Date of Patent: Sep. 25, 2012

(54) PROBE CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 99 days.

(21) Appl. No.: 13/028,215

(22) Filed: Feb. 15, 2011

(65) Prior Publication Data

US 2012/0208406 A1 Aug. 16, 2012

(51) Int. Cl.
*H01R 13/24* (2006.01)

(52) U.S. Cl. ..... 439/700; 439/824

(58) Field of Classification Search ..... 439/824, 439/674, 700, 881, 855, 902
See application file for complete search history.

(56) References Cited

U.S. PATENT DOCUMENTS 4,892,491 A * 1/1990 Budano et al. ..... 439/582
5,393,240 A * 2/1995 Makal et al. ..... 439/187
5,681,187 A * 10/1997 Fukushima et al. ..... 439/700
6,416,338 B1 * 7/2002 Berlovan ..... 439/187
6,935,906 B2 * 8/2005 Orihara ..... 439/824
7,217,142 B1 * 5/2007 Wu ..... 439/79
7,815,474 B1 * 10/2010 Lin et al. ..... 439/700
7,914,348 B1 * 3/2011 Lin ..... 439/700
8,052,470 B1 * 11/2011 Lin ..... 439/607.01
8,062,078 B2 * 11/2011 Asai et al. ..... 439/823
8,066,534 B1 * 11/2011 Lin ..... 439/700
8,066,537 B1 * 11/2011 Lin ..... 439/824
8,083,548 B1 * 12/2011 Lin ..... 439/607.34
2011/0124215 A1 * 5/2011 Yin et al. ..... 439/169
2011/0318944 A1 * 12/2011 Lin et al. ..... 439/83

* cited by examiner

*Primary Examiner* — Renee Luebke
*Assistant Examiner* — Larisa Tsukerman
(74) *Attorney, Agent, or Firm* — Lin & Associates IP, Inc.

(57) ABSTRACT

A probe connector adapted for fastening a cable thereto includes an insulating housing and a plurality of probe pin assemblies. The insulating housing defines a plurality of fastening openings and inserting holes penetrating therethrough. The probe pin assembly includes a shell, a plunger and an elastic element assembled in the shell. The shell has a barrel partly received in the inserting hole, and a box-shaped base shell received in the fastening opening. The base shell has a rear plate extending rearward. The rear plate extends rearward to form a connecting piece of which two opposite side edges define two clipping pieces capable of being bent towards each other to clip a core wire of the cable therebetween. The plunger partially projects out of the barrel and the inserting hole. Then the rear plate is bent downward to make the probe pin assembly be a right-angled shape.

5 Claims, 4 Drawing Sheets

PROBE CONNECTOR

BACKGROUND OF THE INVENTION

1. Field of the Invention

The present invention relates to a probe connector, and more particularly to a probe connector capable of being assembled easily.

2. The Related Art

A traditional probe connector generally includes an insulating housing and a plurality of probe pin assemblies. The insulating housing defines a plurality of inserting holes each penetrating therethrough. The probe pin assembly includes a barrel, a plunger and an elastic element. The elastic element is received in the barrel. The plunger is movably inserted in the barrel and partially projected out of the barrel under the action of the elastic element. The probe pin assemblies are received in the inserting holes of the insulating housing respectively.

However, if a cable is needed to perpendicularly connect with the probe connector, the only method is to mold the cable with the probe pin assembly of the probe connector integrally. So that a new precision die is specially needed accordingly, and a manufacturing cost is increased and manufacturing efficiency is lowered.

SUMMARY OF THE INVENTION

An object of the present invention is to provide a probe connector adapted for fastening a cable thereto. The probe connector includes an insulating housing and a plurality of probe pin assemblies partially inserted in the insulating housing. A rear of the insulating housing defines a plurality of fastening openings spaced at regular intervals. A front sidewall of each fastening opening defines an inserting hole longitudinally penetrating forward through the insulating housing. Each of the probe pin assemblies includes a shell, a plunger and an elastic element. The shell has a barrel which passes forward through the fastening opening to be inserted in the inserting hole with a front end thereof projecting out of the inserting hole, and a box-shaped base shell received in the fastening opening and defining an accommodating chamber therein. The base shell is connected with the barrel with a rear end of the barrel facing the accommodating chamber. The base shell has a top plate of which a rear edge opposite to the barrel extends rearward to form a rear plate. A rear of the rear plate further extends rearward to form a connecting piece of which two opposite side edges oppositely extend outward to form a pair of clipping pieces. The clipping pieces are capable of being bent towards each other to clip a core wire of one end of the cable therebetween for realizing an electrical connection between the cable and the probe connector. The plunger is movably inserted in the barrel along a rear-to-front direction and further projects out of the front end of the barrel and the inserting hole. The elastic element is telescopically assembled in the barrel and the accommodating chamber of the base shell along the rear-to-front direction, with a front end thereof resisting against a rear end of the plunger. Then the rear plate is bent downward to cover up a rear end of the accommodating chamber and make the probe pin assembly show a substantially right-angled shape viewed from a lateral view. A rear end of the elastic element further abuts against an inner side of the rear plate to prevent the plunger and the elastic element falling off from the barrel.

As described above, before the rear plate is bent downward, the plunger is movably inserted in the barrel and the elastic element are partially inserted in the barrel along the rear-to-front direction so as to make the plunger and the elastic element assembled in the barrel conveniently. Then the rear plate is bent downward to form the rectangular box-shaped base shell, and the other end of the elastic element further abuts against an inner side of the rear plate of the base shell to prevent the plunger and the elastic element falling off from the barrel. Furthermore, the probe pin assembly of the right-angled shape can make the cable perpendicularly secured to the probe connector tightly, no new precision die is specially needed, so manufacturing cost is lowered and manufacturing efficiency is improved.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
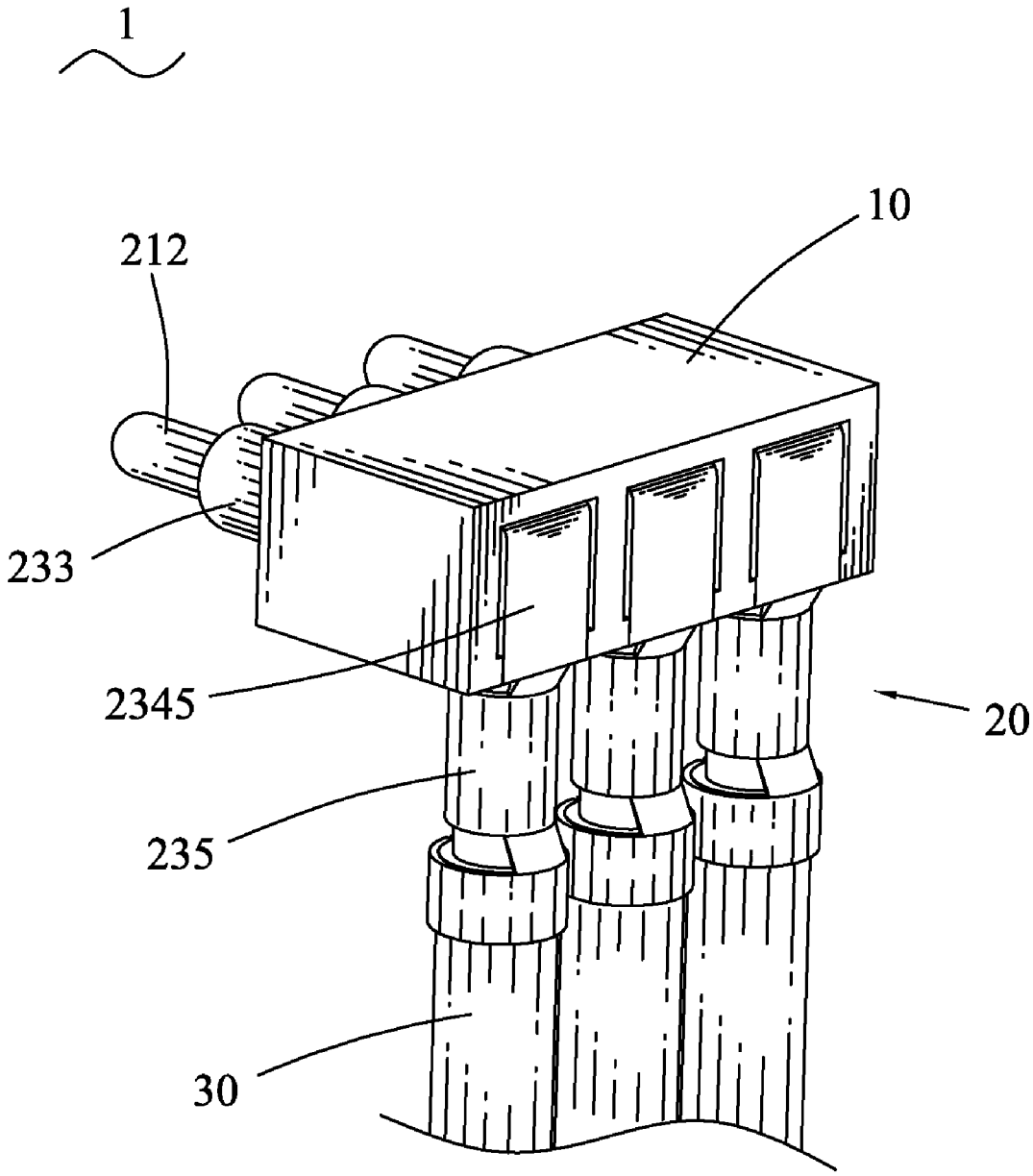
FIG. 1 is a perspective view of a probe connector according to the present invention.

With reference to FIG. 1, a probe connector 1 according to the present invention includes an insulating housing 10 and a plurality of probe pin assemblies 20.

Figure 2:
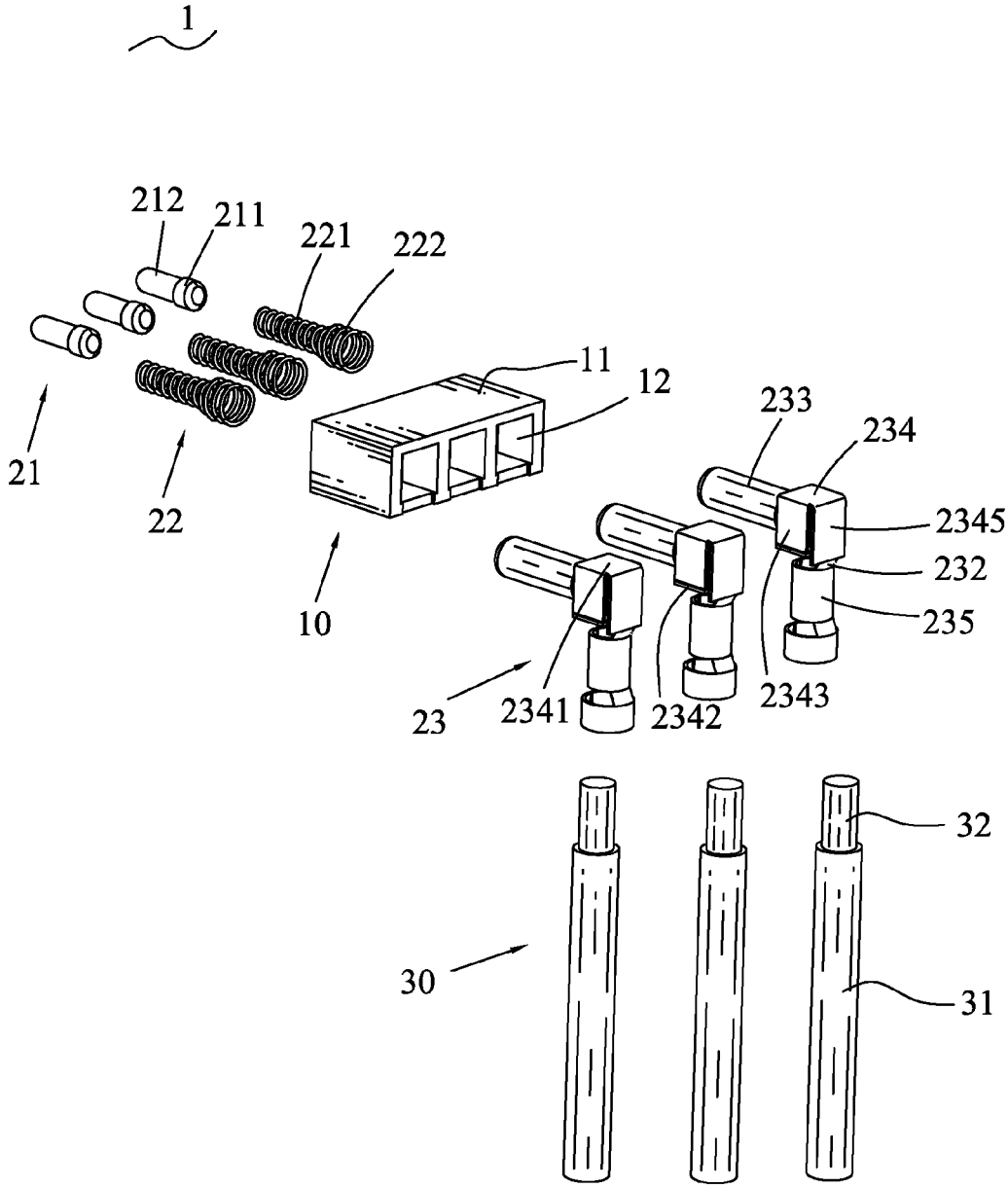
FIG. 2 is an exploded perspective view of the probe connector of FIG. 1.
Figure 3:
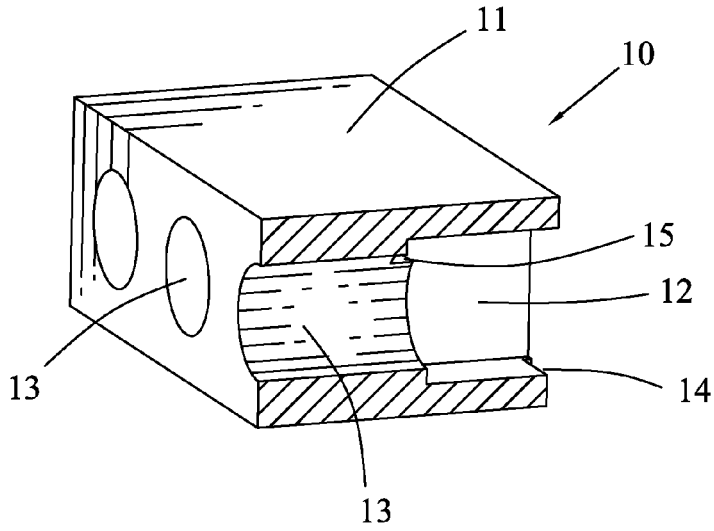
FIG. 3 is a sectional view of an insulating housing of the probe connector of FIG. 1.

With reference to FIGS. 2-3, the insulating housing 10 has a base body 11 of a rectangular shape. A rear of the base body 11 defines a plurality of rectangular fastening openings 12 arranged in an alignment and spaced at regular intervals. A middle of a front sidewall of the fastening opening 12 defines an inserting hole 13 longitudinally penetrating forward through the base body 11. A top of a rear end of the inserting hole 13 is concaved upward to form a receiving groove 15 connecting with the fastening opening 12. A bottom of a rear end of the fastening opening 12 is concaved inward to form a locating groove 14.

With reference to FIGS. 1-2, each of the probe pin assemblies 20 includes a plunger 21 with a top end shaped as a dome, an elastic element 22 and a shell 23.

Figure 4:
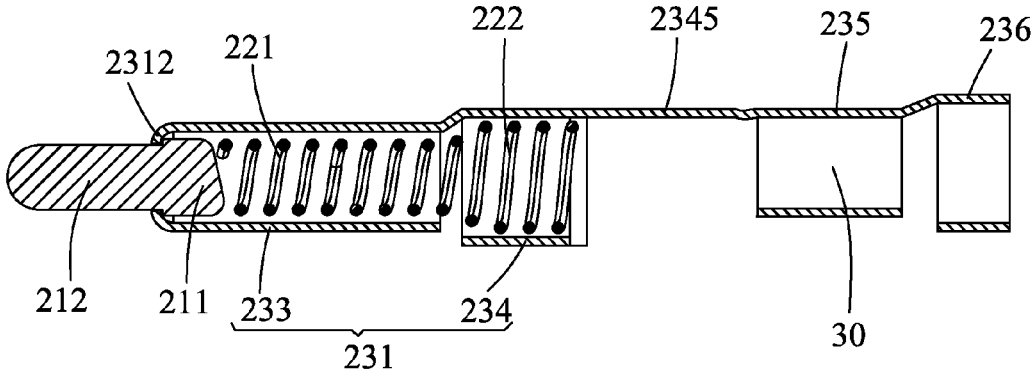
FIG. 4 is a cross-sectional view of a probe pin assembly of the probe connector of FIG. 2.
Figure 5:
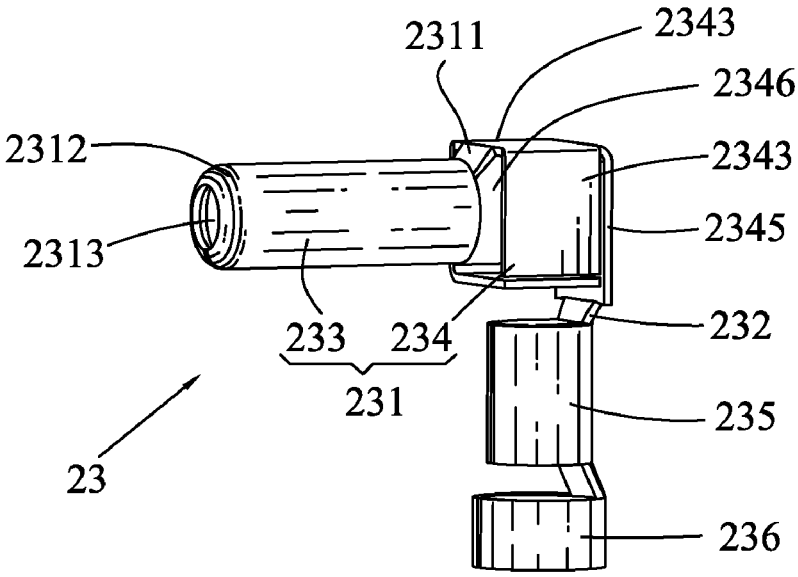
FIG. 5 is a perspective view of a shell of the probe pin assembly of FIG. 2.

Referring to FIG. 2, FIG. 4 and FIG. 5, the plunger 21 has a cylindrical base portion 211 and a touching portion 212 protruding forward from a middle of a front of the base portion 211. The elastic element 22 has a first elastic section 221 and a second elastic section 222 connecting with a rear end of the first elastic section 221 and having a diameter thereof wider than that of the first elastic section 221. The shell 23 is made of metal material, and includes a receiving shell 231 and a connecting piece 232 connected with the receiving shell 231. The receiving shell 231 includes a hollow barrel 233 looped from a metal plate and having a front end and a rear end opened freely, and a base shell 234 connecting with the barrel 233. A periphery of the front end of the barrel 233 is shrunk inward to form a ring-shaped blocking portion 2312 with a fastening hole 2313 being formed in a middle thereof. The base shell 234 is of a rectangular box-shape with a rectangular accommodating chamber 2346 thereamong. The base shell 234 has a top plate 2341, a bottom plate 2342 parallel to the top plate 2341, two side plates 2343 connecting with the top plate 2341 and the bottom plate 2342, and a rear plate 2345 extending rearward from a rear edge of the top plate 2341 opposite to the barrel 233. A middle of a rear edge of the barrel 233 and a middle of a front edge of the top plate 2341 are connected by an inclined piece 2311 to make the barrel 233 located in front of the base shell 234 properly with a rear end of the barrel 233 facing the accommodating chamber 2346. A middle of a rear edge of the rear plate 2345 further extends rearward to form the connecting piece 232 of long strip shape. Two opposite side edges of a rear portion of the connecting piece 232 oppositely extend outward to form a pair of clipping pieces 235 apart from the bottom plate 2342 and a rear end of the connecting piece 232 opposite to the rear plate 2345. Two opposite side edges of the rear end of the connecting piece 232 also oppositely extend outward to form a pair of fastening pieces 236 wider than the corresponding clipping pieces 235.

Referring to FIG. 1, FIG. 2, FIG. 4, FIG. 5 and FIG. 6, when the probe pin assembly 20 is assembled, the plunger 21 is movably inserted in the barrel 233 along a rear-to-front direction with the touching portion 212 thereof further projecting out of the fastening hole 2313 of the barrel 233 to connect with a mated connector, and the base portion 211 thereof movably restrained in the barrel 233 and blocked by the blocking portion 2312. The elastic element 22 is partly inserted in the barrel 233 along the rear-to-front direction with the first elastic section 221 thereof resisting against the base portion 211 of the plunger 21, and the second elastic section 222 thereof projecting out of the rear end of the barrel 233. Then the rear plate 2345 is bent downward to cover up a rear end of the accommodating chamber 2346 to connect together with the top plate 2341, the bottom plate 2342 and the two side plates 2343 to form the rectangular box-shaped base shell 234 for receiving the second elastic section 222 of the elastic element 22 in the accommodating chamber 2346. The second elastic section 222 of the elastic element 22 further abuts against an inner side of the rear plate 2345 of the base shell 234. After assembling the probe pin assembly 20, the probe pin assembly 20 shows a substantially right-angled shape viewed from a lateral view.

Referring to FIGS. 1-6, when the probe connector 1 is assembled, the probe pin assemblies 20 are fastened in the insulating housing 10. The base shell 234 is received in the fastening opening 12 with the inclined piece 2311 being received in the receiving groove 15 and a front edge of the bottom plate 2342 being against a lower portion of a rear end of the inserting hole 13. A bottom end of the rear plate 2345 is restrained in the locating groove 14. The barrel 233 passes forward through the fastening opening 12 to make a rear portion of the barrel 233 received in the inserting hole 13. A front end of the barrel 233 and the plunger 21 are projected out of the inserting hole 13.

Figure 6:
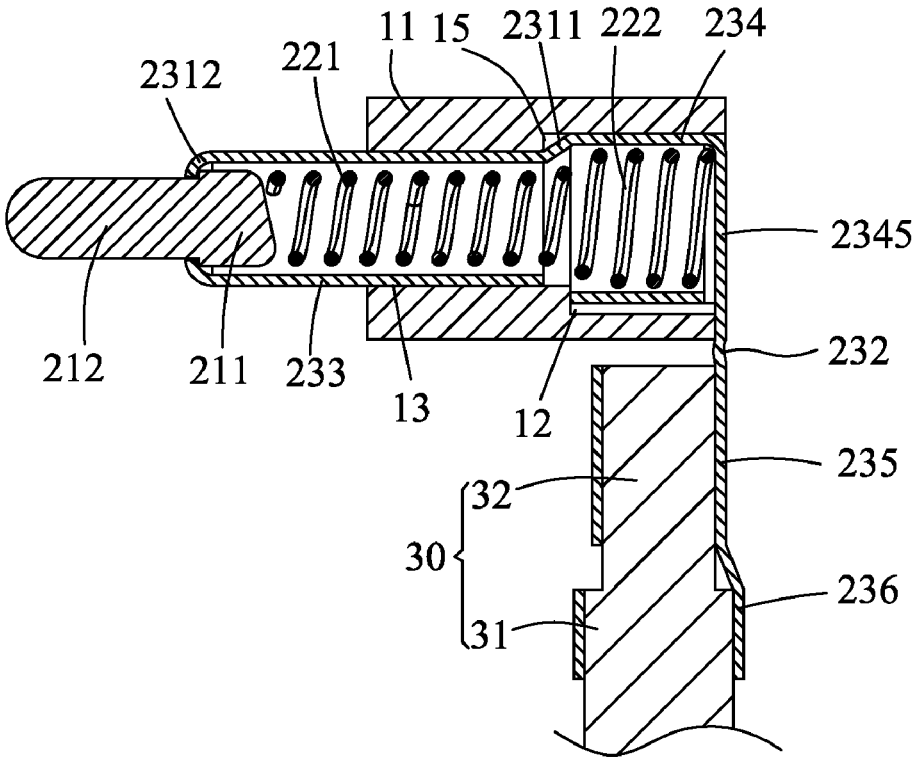
FIG. 6 is a cross-sectional view of the probe connector of FIG. 1.

Referring to FIG. 1, FIG. 2 and FIG. 6, a cable 30 is secured to the probe connector 1, and includes a dielectric layer 31 and a core wire 32 surrounded by the dielectric layer 31 except one end thereof. When the cable 30 is assembled to the probe connector 1, the one end of the core wire 32 without being surrounded by the dielectric layer 31 is disposed on the lower portion of the connecting piece 232 between the pair of clipping pieces 235, with the dielectric layer 31 adjacent to the one end of the core wire 32 being against the bottom end of the connecting piece 232 between the pair of fastening pieces 236. Then the clipping pieces 235 are arched towards each other to show a ring shape for tightly clipping the one end of the core wire 32 therebetween, and the fastening pieces 236 are also arched towards each other to show a ring shape for tightly clipping the dielectric layer 31 together with the core wire 32 therebetween. Consequently, the cable 30 can be perpendicularly secured to the probe connector 1 tightly and a good electrical connection between the cable 30 and the probe connector 1 is realized accordingly.

As described above, before the rear plate 2345 is bent downward, the plunger 21 is movably inserted in the barrel 233 and the elastic element 22 are partially inserted in the barrel 233 along the rear-to-front direction so as to make the plunger 21 and the elastic element 22 assembled in the barrel 233 conveniently. Then the rear plate 2345 is bent downward to form the rectangular box-shaped base shell 234, and the second elastic section 222 of the elastic element 22 further abuts against an inner side of the rear plate 2345 of the base shell 234 to prevent the plunger 21 and the elastic element 22 falling off from the barrel 233. Furthermore, the probe pin assembly 20 of the right-angled shape can make the cable 30 perpendicularly secured to the probe connector 1 tightly, no new precision die is specially needed, so manufacturing cost is lowered and manufacturing efficiency is improved.

What is claimed is:

1. A probe connector adapted for fastening a cable thereto, comprising:

an insulating housing, a rear of the insulating housing defining a plurality of fastening openings spaced at regular intervals, a front sidewall of each fastening opening defining an inserting hole longitudinally penetrating forward through the insulating housing; and a plurality of probe pin assemblies each including a shell having a barrel which passes forward through the fastening opening to be inserted in the inserting hole with a front end thereof projecting out of the inserting hole, and a box-shaped base shell received in the fastening opening and defining an accommodating chamber therein, the base shell being connected with the barrel with a rear end of the barrel facing the accommodating chamber, the base shell having a top plate of which a rear edge opposite to the barrel extends rearward to form a rear plate, a rear of the rear plate further extending rearward to form a connecting piece of which two opposite side edges oppositely extend outward to form a pair of clipping pieces, wherein the clipping pieces are capable of being bent towards each other to clip a core wire of one end of the cable therebetween for realizing an electrical connection between the cable and the probe connector, a plunger movably inserted in the barrel along a rear-to-front direction and further projecting out of the front end of the barrel, and an elastic element telescopically assembled in the barrel and the accommodating chamber of the base shell along the rear-to-front direction, with a front end thereof resisting against a rear end of the plunger, then the rear plate being bent downward to cover up a rear end of the accommodating chamber and make the probe pin assembly show a substantially right-angled shape viewed from a lateral view, a rear end of the elastic element further abutting against an inner side of the rear plate to prevent the plunger and the elastic element falling off from the barrel.

2. The probe connector as claimed in claim 1, wherein a bottom of a rear end of the fastening opening defines a locating groove for receiving a bottom of the rear plate bent downward.

3. The probe connector as claimed in claim 1, wherein a rear edge of the barrel and a front edge of the top plate of the base shell are connected by an inclined piece, a top of a rear end of the inserting hole is concaved upward to form a receiving groove connecting with the fastening opening for receiving the inclined piece therein.

4. The probe connector as claimed in claim 1, wherein the clipping pieces are arched towards each other to together form a ring shape for securing the core wire of the one end of the cable therebetween.

5. The probe connector as claimed in claim 1, wherein the clipping pieces are formed apart from a free end of the connecting piece opposite to the rear plate, two opposite side edges of the free end of the connecting piece oppositely extend outward beyond the corresponding clipping pieces to form a pair of fastening pieces which are capable of being arched towards each other to together form a ring shape for fastening the one end of the cable therebetween.

* * * * *